United States Patent [19]

Jacobs et al.

[11] 4,201,283

[45] May 6, 1980

[54] PILFERAGE PROTECTION FOR SATELLITE VENDING MACHINE HAVING DUAL PRICING CAPABILITY

[75] Inventors: Philip F. Jacobs; Evelyn Friedman; Peter Southall; William Carswell, all of Whitehall, N.Y.

[73] Assignee: E. B. Metal Rubber Industries, Inc., Whitehall, N.Y.

[21] Appl. No.: 911,223

[22] Filed: May 31, 1978

[51] Int. Cl.[2] ..... G07F 11/20

[52] U.S. Cl. ..... 194/1 A; 194/1 L; 221/125; 221/130

[58] Field of Search ..... 221/125, 130, 131, 197; 194/2, 10, 94, 1 A, 1 L

[56] References Cited

U.S. PATENT DOCUMENTS

| | | | |
|---|---|---|---|
| 2,305,342 | 12/1942 | Fry | 221/130 X |
| 2,952,384 | 9/1960 | Holstein et al. | 221/104 |
| 2,991,867 | 7/1961 | Schuller | 194/18 |
| 3,128,908 | 4/1964 | Holstein et al. | 221/105 |
| 4,121,707 | 10/1978 | Jacobs et al. | 194/10 |

*Primary Examiner*—F. J. Bartuska

[57] ABSTRACT

A satellite vending machine having a tier of manually operated ejectors for dispensing a selection of packaged articles from storage magazines therein to expand the capacity of a parent vending machine is installed on top of the parent and utilizes the coin-actuated totalizer unit and associated mechanism of the parent and provides a linkage to its own heavy duty mechanism responsive to the latch positions in the parent as pilferage protection. The dual pricing capability of the parent is extended to the satellite by a linkage from the ejectors of the magazines having the higher priced articles in the satellite to the latch mechanism of the parent to lock both parent and satellite latch mechanisms when a higher priced ejector in the satellite is pulled with the deposit of coins sufficient only for the lower priced articles. When a proper amount of coins is deposited, a mutual lockout function between satellite and parent locks the ejectors in the parent when an ejector in the satellite is operated and vice versa.

18 Claims, 8 Drawing Figures

PILFERAGE PROTECTION FOR SATELLITE VENDING MACHINE HAVING DUAL PRICING CAPABILITY

BACKGROUND OF THE INVENTION

1. Field of the Invention

This invention generally relates to the interconnecting mechanism between a mechanically operated parent vending machine and a satellite vending machine installed on top of the parent to increase its capacity, the satellite being operable by deposit of coins in the coin-actuated totalizer unit of the parent. More specifically, the invention is based on and is an improvement of the mechanisms disclosed in the pending patent application of Philip F. Jacobs et al, filed on Feb. 23, 1977, Ser. No. 771,377, now U.S. Pat. No. 4,121,707 granted on Oct. 24, 1978, entitled Satellite Vending Machine, and relates to a heavy duty latch mechanism in the satellite under the direct control of the existing latch mechanism of the parent and to an improvement whereby a two price capability of the parent may be extended to the satellite.

2. Description of the Prior Art

Satellite vending machines connected to mechanically operated parent vending machines of constructions described in said patent rely on the same linkage between parent and satellite to lock out the operation of the satellite when no coins or an insufficient amount of coins are deposited in the parent and also to perform a mutual lockout function between satellite and parent when proper coins are deposited to immobilize the ejectors in the parent when an ejector in the satellite is operated and vice versa. It has been found that application of excessive force, within the capability of a person to apply, exerted on one of the easy-to-grasp ejector handles in the satellite will often overpower and damage this linkage, permitting unpaid for delivery of merchandise and, what is more serious, putting the satellite and perhaps also the parent machine out of operation and requiring expensive and time consuming repairs. This application of force by a purchaser is apt to occur when insufficient coins are inadvertently deposited or when the coin-actuated totalizer unit (also referred to herein as the ACMR or accumulator unit) fails for any reason to unlatch the latch mechanism in the parent machine. Thus, the satellites of the construction described in said patent may be vulnerable to both deliberate pilferage attempts and to abuse by disgruntled purchasers.

When the satellite described in said patent is equipped for high priced vending, this same linkage is relied on to prevent delivery of the high priced merchandise when only coins sufficient for the low priced merchandise are deposited. Hence, it would be advantageous to correct the noted problems to preserve the satellite concept and its advantages.

SUMMARY OF THE INVENTION

Among the objects of the invention is to generally improve the construction and operation of the satellite vending machine in conjunction with either of the two types of mechanical parent vending machines described and shown in said patent and to eliminate the problems hereinbefore stated by providing a heavy duty latch mechanism within the satellite and a mechanical linkage between such latch mechanism and the existing latch mechanisms of said two types of parent machines. The linkages between the respective latch mechanisms shall be easy to install and to incorporate with existing parent machine components, preserving the economy and practicality of converting existing vending machines to satellite operation, and which shall function in a jam-free manner and without imposing undue stress and strain on the operation of the parent.

The invention thus provides a combination of a parent vending machine with a satellite machine mounted thereon, each machine having a plurality of ejectors, each of which is adapted to dispense an article stored in an associated magazine by selective manual pullout and return actuation thereof. The interconnection between the machines which provides for operation of the satellite based on coins deposited in the parent includes a mutual lockout linkage means for all ejectors in both parent and satellite with the exception of the selected ejector when a predetermined amount of coins are deposited in the parent machine and also provides cooperating latch means located in both parent and satellite machines locking out all of the ejectors when no coins or less than the predetermined amount of coins are deposited in the parent machine.

More specifically as to the cooperating latch means, each machine has an intermediate means engaged and operated by each of the ejectors thereof in the pullout actuation. Each machine also has a latch mechanism which, when in latched position, obstructs movement of the respective intermediate means and hence each of the ejectors thereof beyond a predetermined initial distance thereby locking out each of the ejectors from dispensing articles. The coin-actuated totalizer or accumulator unit located in the parent receives the deposit of coins and has a main coin handling shaft operated by the intermediate means in the parent and also by the intermediate means in the satellite through a linkage between parent and satellite. The deposit of the predetermined amount of coins in the totalizer or accumulator unit enables the movement through the initial distance of the selected ejector in either the parent or satellite to release the latch mechanism in the parent to an unlatched position. Simultaneously, a linkage between the parent and satellite latch mechanisms responds to the positioning of the latch mechanism in the parent and similarly sets the satellite latch mechanism whenever the selected ejector is in the satellite. Likewise, failure to deposit the predetermined amount of coins, when an ejector in the satellite is pulled, results in the obstruction of both intermediate means by their respective latch mechanisms at the end of the initial distance movement. Under these conditions, all the ejectors in the satellite are locked out by their own latch mechanism which has a heavy duty aspect, in that, when in latched position, any force exerted to move any one of the ejectors in the satellite beyond the initial distance is transmitted by the satellite latch mechanism to the frame of the satellite rather than through the above mentioned mutual lockout linkage or the linkage between the latch mechanisms.

The invention also provides a dual pricing capability for the satellite and a versatility whereby the plurality of ejectors and associated storage magazines can easily be set for operation solely at the lower price, partially at the lower and partially at the higher price, and solely at the higher price, while in each case utilizing the heavy duty latch mechanism as pilferage protection when a high priced ejector is actuated with an inadequate deposit of coins.

To achieve dual pricing, the latch mechanisms of parent and satellite each have two independently operable latches and linkages therebetween for operating in concert, one pair of latches and linkage performing the function hereinbefore described and being under the control of all ejectors, the other pair of latches and linkage therebetween being reserved for operation by those ejectors set up for dispensing the higher priced articles. While the latch in the parent machine of the first pair of latches is normally in a latched position when at rest, a high price differential linkage in the parent, interconnected with an actuating means in the satellite, normally retains the second pair of latches in an unlatched position. The ejectors in the satellite intended for high price vending, being setup with means for individually engaging the actuating means connected to the high price differential linkage, when pulled out the predetermined initial distance, trip the latches of the second pair into latched positions which obstruct movement of the respective intermediate means beyond the initial distance preventing dispensing of articles. The coin-actuated totalizer or accumulator unit is set to receive an additional predetermined amount of coins for the high priced articles, which amount, when deposited, enables the operation of the main coin handling shaft to independently retain the second pair of latches in unlatched position so that whenever the high price differential linkage is tripped by operation of a high price ejector, this independent retention permits the higher priced article to be dispensed.

DESCRIPTION OF THE PREFERRED EMBODIMENTS

Figure 1:
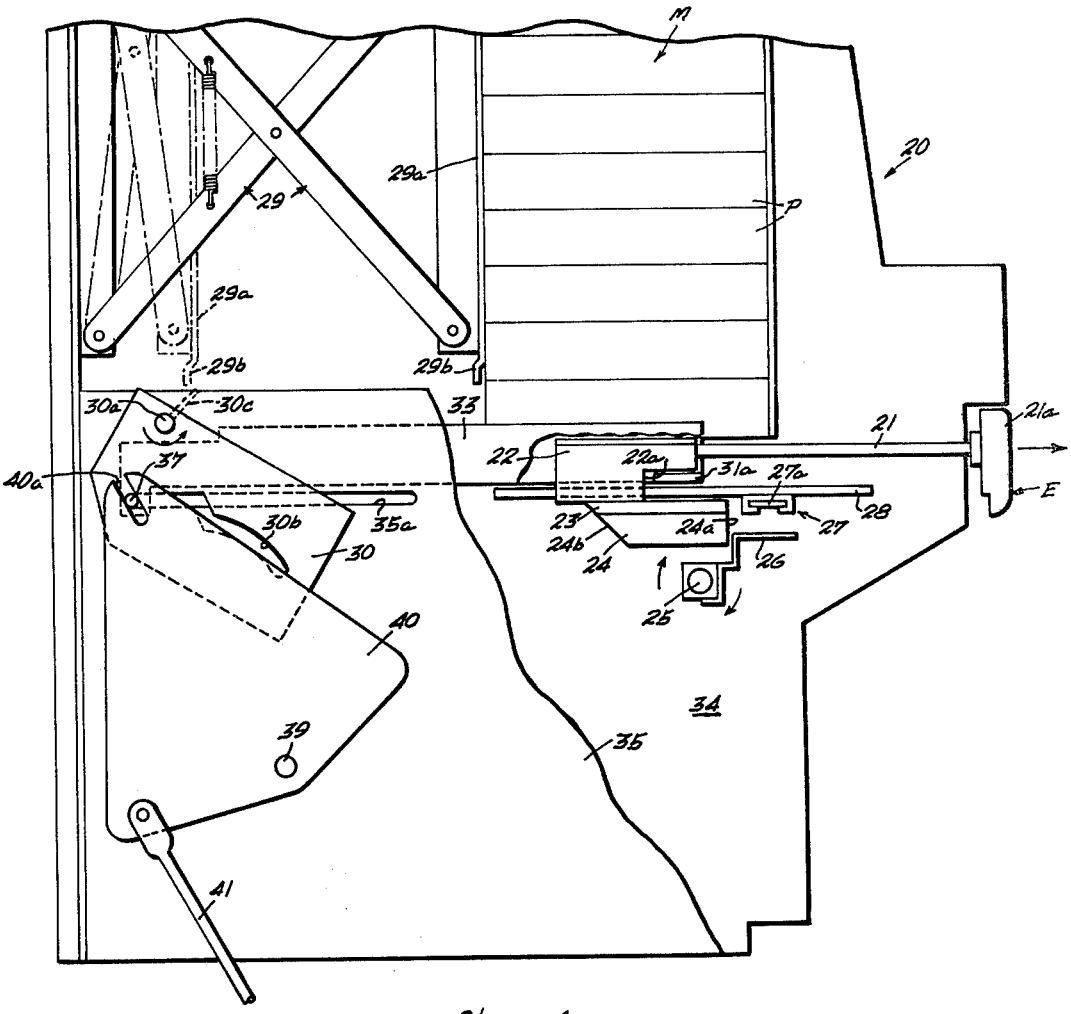
FIG. 1 is a fragmentary side elevational view of the left sidewall of the satellite vending machine embodying the invention showing components of the mutual lockout function, with parts of the left sidewall broken away to show an ejector fitted for high price vending.

Referring in detail to the drawings, 20 generally denotes a satellite vending machine installed on top of either of two types of parent vending machines 75 and 175, all substantially similar to those shown and described in said patent except for the modifications embodying this invention specifically shown and described herein. Thus, the merchandise stacking magazines M and the mechanism for dispensing a package P therefrom under the selective operation of each of the ejectors E in satellite 20 are identical to those described and shown in said patent. Only such particular aspects of the mechanism as required for an understanding of this invention are hereinafter described and shown in the drawings.

Figure 2:
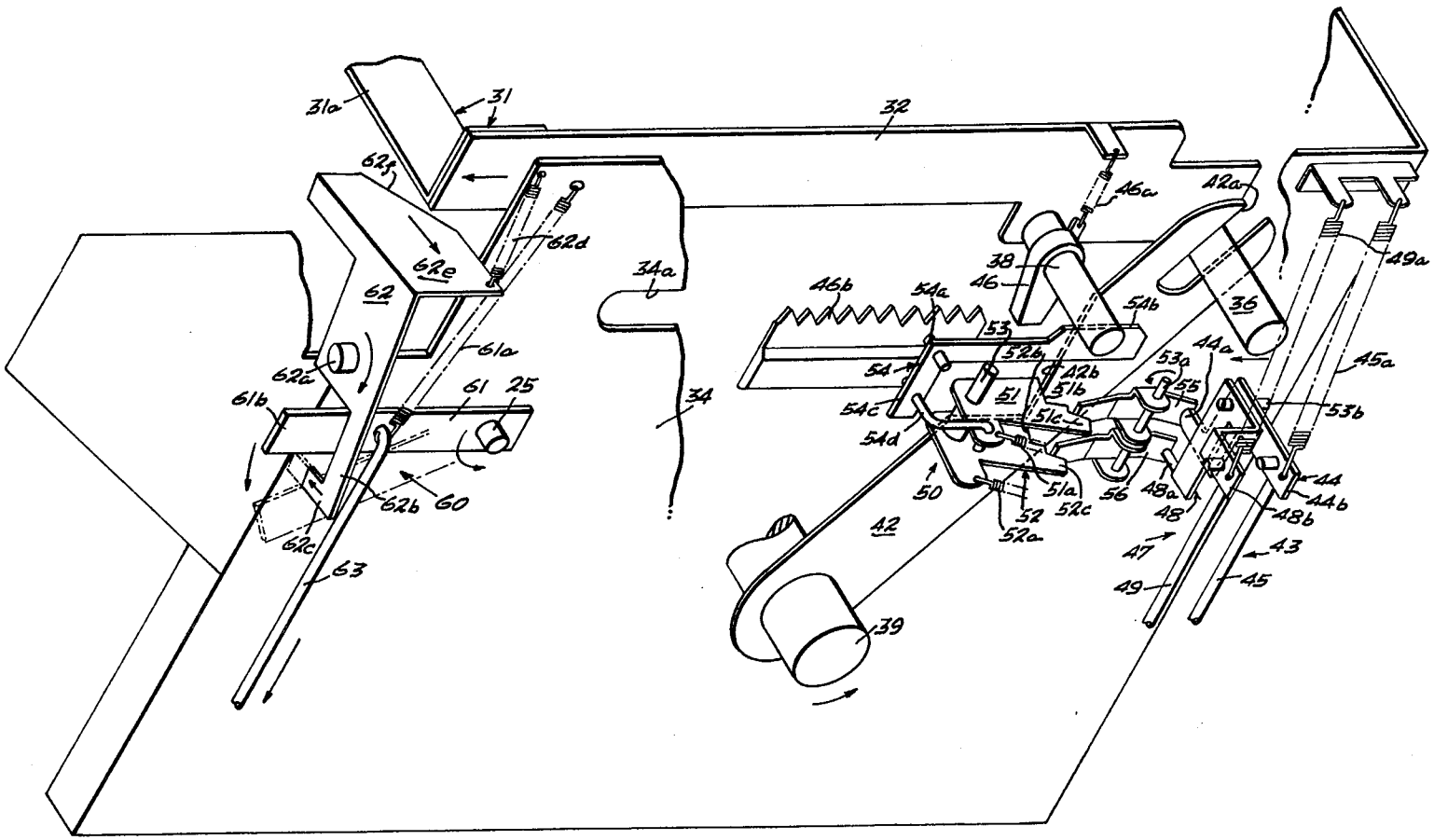
FIG. 2 is a fragmentary schematic perspective view of the right sidewall of the satellite vending machine shown in FIG. 1 with parts broken away showing details of the heavy duty latch mechanism for dual price vending capability and the high price coin detection mechanism embodying the invention.

A drawbar assembly 31, shown in FIGS. 1 and 2, comprises a transverse drawbar **31*a* connected at opposite ends to the front ends of right and left side arms 32 and 33, respectively, and another transverse bar (not shown) connecting the rear ends thereof as a rigid structure. Right and left side arms 32 and 33 are mounted for forward and rearward movement on the interior of right and left sidewalls 34 and 35, respectively, the latter being mounted on a suitable frame within the housing of satellite 20 at opposite ends of the bank of ejectors E and their associated magazines M and serve as supporting structure for the components actuated by the drawbar assembly 31**.

Each ejector E, as shown in FIG. 1, comprises an ejector rod 21 having a front end extending through the housing of satellite 20 terminating in a handle **21*a* and a pack pusher head 22 at its rear end, head 22 having a downwardly extending edge 22*a* located rearwardly of transverse drawbar 31*a* to engage the latter and impart forward movement to drawbar assembly 31. Also depending from a lower portion of head 22 which projects through a slot in horizontal platform 28 is a web 23 which extends forwardly of and below edge 22*a* to slide between and separate a pair of bars or tumblers 27*a* of the selector bar mechanism 27 on forward movement of rod 21. This separation or gap formation in selector bar mechanism 27 locks out the other ejectors E of the satellite by preventing further gap formation in mechanism 27 in a manner well known in the art and described in said patent which also explains the manner in which head 22** dispenses a package P from magazine M.

In FIG. 1, pack pusher head 22 is shown to include a cam plate 24 formed as a downward extension of web 23 having a vertical leading edge **24*a* and an opposite inclined trailing edge 24*b*. A shaft 25, which may be journaled at opposite ends in right and left sidewalls 34 and 35 to extend transversely therebetween, carries an elongated lever arm 26 extending beneath all ejector rods 21 and in the path of movement of each of the cam plates 24. Shaft 25 with lever arm 26 are components of the high price coin detection mechanism 60 hereinafter described as providing said dual price vending capability for satellite 20. Thus, only those ejectors E operating a magazine M stocked with high priced merchandise are provided with a cam plate 24 which constitutes the sole interconnection between ejectors E and the high price coin detection mechanism 60 (see FIG. 2**).

The rear portion of left sidewall 35 has an elongated horizontal slot **35*a* located to accommodate the reciprocating movement imparted by drawbar assembly 31 to stub shaft 37 which extends therethrough and is mounted on a rear, downwardly offset end portion of left side arm 33. Various components are shown in FIG. 1 for purposes of disclosure, but form no direct part of this invention. Such components, which will be readily recognized as identical to those shown in FIGS. 2 and 9 of said patent and described in detail therein, although having different reference numerals, include the movable back wall scissor linkages 29, one for each of the magazines M, plate 30 located on the exterior side of left sidewall 35 and mounted on transverse shaft 30***a*, cam slot 30*b* formed in plate 30 in which shaft 37 rides to rotate plate 30 and shaft 30*a*, and levers 30*c* which are mounted to move with shaft 30*a* for engaging tabs 29*b* depending from each movable back wall 29*a*.

Figure 4:
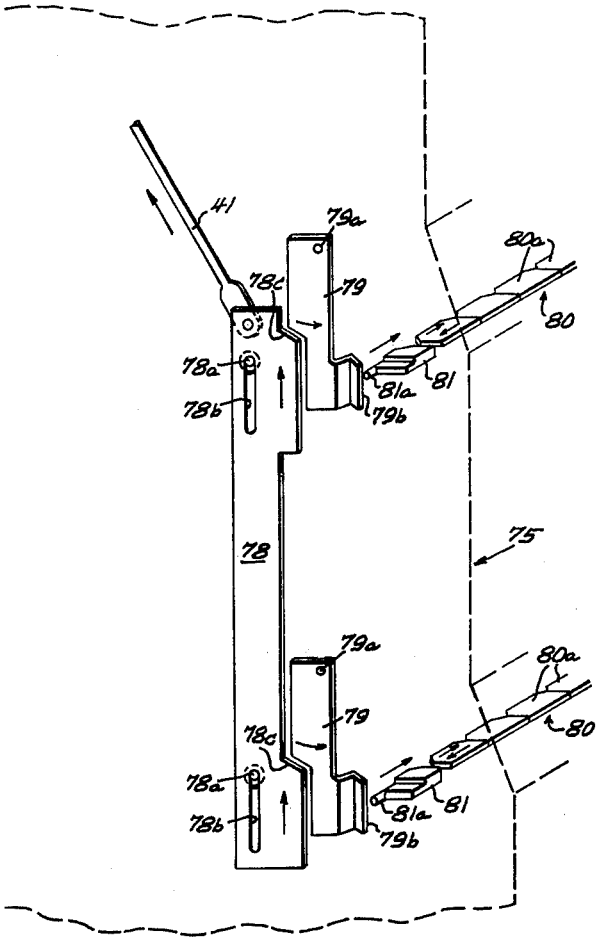
FIG. 4 is a fragmentary schematic perspective view of the left side of the parent machine shown in FIG. 3 showing components and linkage installed in the parent for the mutual lockout function with the satellite shown in FIG. 1.
Figure 7:
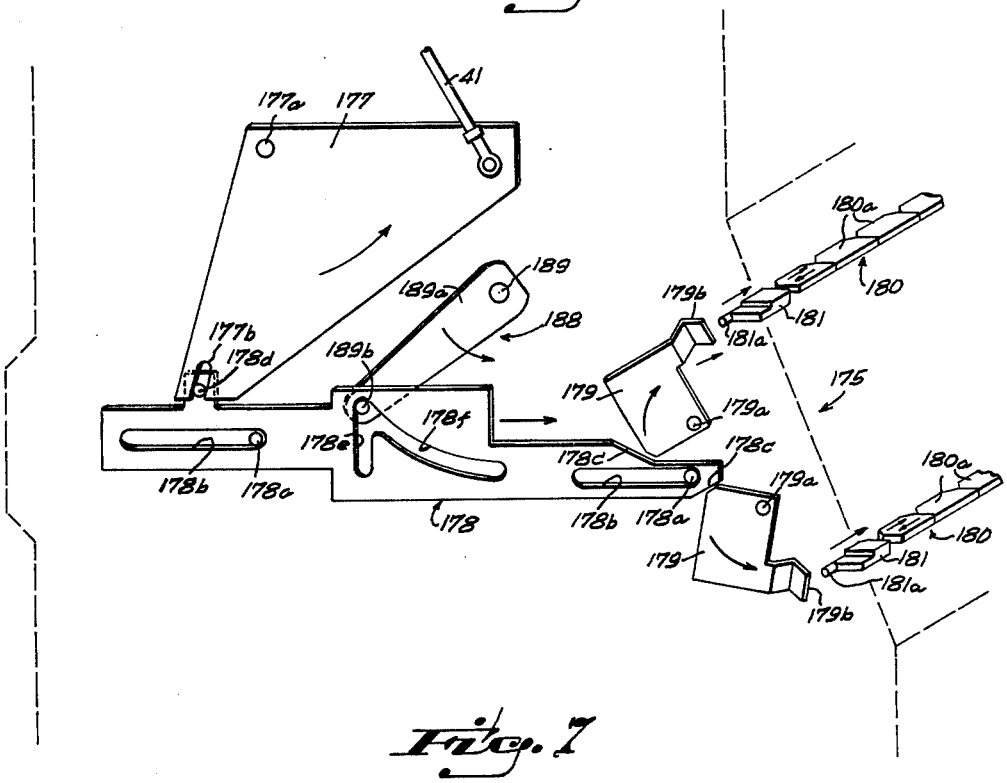
FIG. 7 is a fragmentary schematic perspective view similar to FIG. 4 but of the parent machine shown in FIG. 6 in which the mutual lockout function also incorporates a linkage from the satellite to the coin-actuated totalizer unit of the parent machine.

A shaft 39, journaled in sidewalls 34 and 35 to extend transversely through a lower rear portion of satellite 20, has the left end thereof extending beyond left sidewall 35 and plate 30 to rotatably mount a bell-shaped plate 40 having an open-ended slot 40*a* formed at an upper apex in which shaft 37 rides and a push rod 41 pivoted to a lower corner thereof. It will be clear from FIG. 1 that shaft 37, projecting through horizontal slot 35*a* and engaging slots 30*b* and 40*a*, when moved forwardly with left side arm 33, rotates shaft 30*a* counterclockwise and simultaneously rotates plate 40 clockwise which raises push rod 41. As shown in FIGS. 4 and 7, through the linkages hereinafter more fully described, this raising or pulling up on push rod 41 locks out both tiers of ejectors in either parent machine 75 or 175, respectively.

Figure 3:
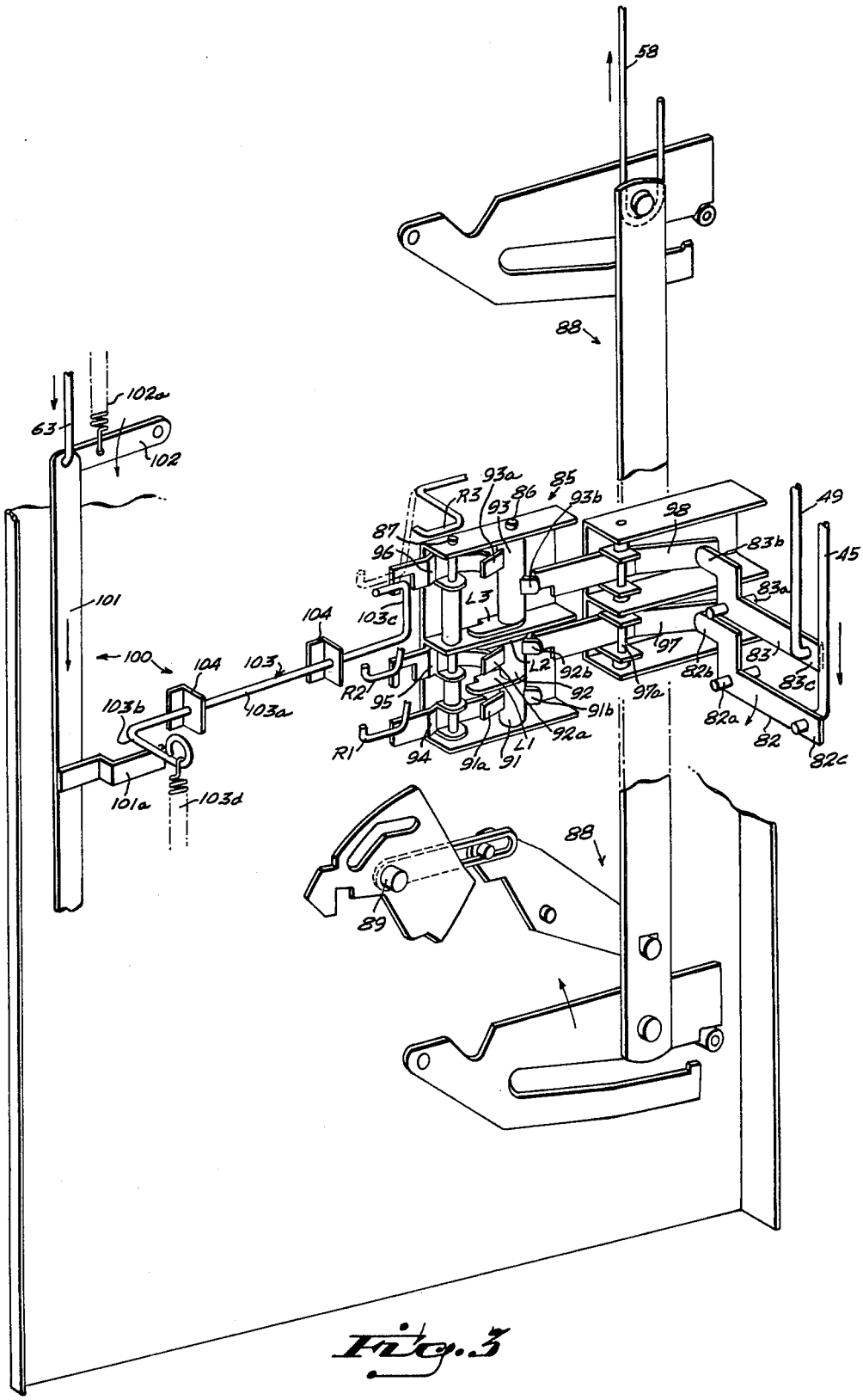
FIG. 3 is a fragmentary schematic perspective view of the right side of the parent machine showing the linkages from the satellite shown in FIG. 2 to the existing latch mechanism and high price coin detection mechanism of the parent.

Parent machine 75 is substantially the vending machine described in U.S. Pat. No. 2,952,384, the left side operating components of which are shown modified for satellite function in FIGS. 5, 5A, 5B and 8 of said U.S. Pat. No. 4,121,707 and shown schematically in FIG. 4 herein with additional modifications but omitting parts not directly involved with the operation of satellite 20. FIG. 3, herein, shows other components of machine 75 involved directly with satellite 20 but located on the right side thereof and modified in accordance with this invention.

Figure 1A:
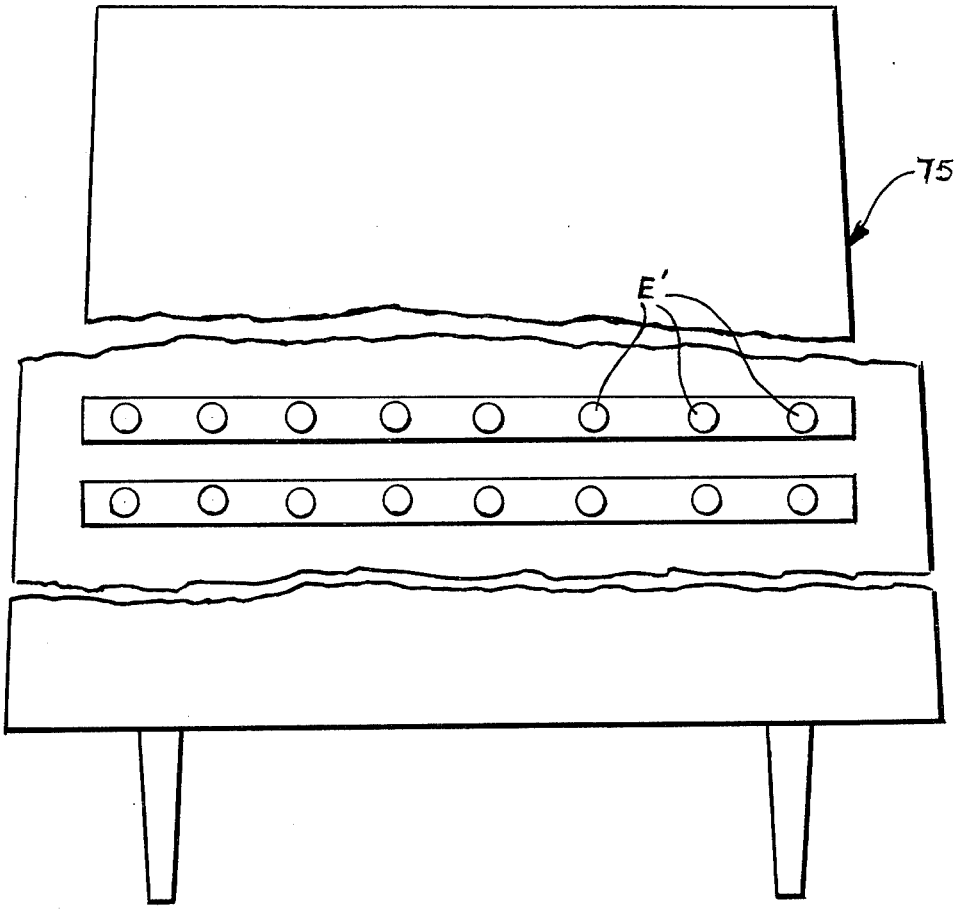
FIG. 1A is a fragmentary front elevation view of the parent machine and its upper and lower tiers of ejectors.

As will be apparent from the description in U.S. Pat. No. 2,952,384, both the upper and lower tiers of ejectors E′ (see FIG. 1A) of parent machine 75 have similar selector bar mechanisms 80 which have been modified, as shown and described in said patent and schematically illustrated in FIG. 4, to each have left end tumblers 81 with an extension 81*a* projecting from the left side thereof for engagement by cam surface 79*b* of blocking plate 79. Each left end tumbler 81 is mounted for limited movement along the slide path of the other tumblers 80*a* between extreme right and left positions, the left position being assumed when an ejector in a tier of parent machine 75 has been operated due to sliding movement of a web, similar to web 23 in FIG. 1, between tumblers 80*a* as more specifically described in said patent. Tumbler 81 is urged into the extreme right position by engagement of cam surface 79*b* with extensions 81*a* wherein all tumblers 80*a* are forced into and retained in abutment with each other and with tumbler 81 to lock out all ejectors on the tier, as occurs when ejector E in satellite 20 is operated as more fully described in said patent.

The engagement of the cam surfaces 79*b* with tumbler extensions 81*a* provides the two-way or mutual lockout function hereinafter more fully described between each of the selector bar mechanism 80 of parent machine 75 and drawbar assembly 31 of satellite 20. The lower end of push rod 41 connects to slide 78 which is suitably mounted on the left sidewall (not shown) of parent machine 75 for vertical movement defined by spaced pins 78*a* fixedly mounted to extend through spaced vertical slots 78*b*. A pair of inclined cam edges 78*c* engage the pair of blocking plates 79 pivotally mounted on pins 79*a* which may also be fixed to the left sidewall. The end opposite pivot pin 79*a* of each blocking plate 79 is formed with a laterally extending cam surface 79*b* offset and disposed at an angle to the plane of rotation of plate 79. Upward movement of slide 78 by push rod 41, as occurs on operating an ejector E in satellite 20, rotates each blocking plate 79 on pin 79*a* in a counterclockwise direction as indicated by the arrows in FIG. 4 so that cam surfaces 79*b* contact tumbler extensions 81*a* and slide tumblers 81 to the extreme right position, completely locking both selector bar mechanisms 80 of parent machine 75.

To summarize, operation of one of the ejectors E in satellite 20 pulls drawbar assembly 31 and stub shaft 37 forward, the latter, engaging slot 40*a*, rotates plate 40 to raise push rod 41 and slide 78 which rotates blocking plates 79 and locks out the selector bar mechanisms 80 on both tiers in parent 75. It will also be apparent that operation of any one of the ejectors on either tier of parent machine 75 will force its respective left end tumbler 81 into the extreme left position whereby extension 81*a* projects to block counterclockwise rotation of the respective blocking plate 79, preventing upward movement of slide 78 and rod 41, and rotation of plate 40 to restrain drawbar assembly 31 against forward movement, thus locking out all ejectors E in satellite 20. The ejectors in the non-operated tier of the parent machine 75 are also simultaneously locked out by suitable means provided therein as more fully disclosed in said pending patent application.

The right side of parent machine 75 houses the coin-actuated totalizer unit (also referred to herein as the ACMR or accumulator unit) of which latch release levers R1, R2 and R3, shown in FIG. 3, are part and are located to unlatch latches L1, L2 and L3 of the latch mechanism, generally designated 85, which, prior to the deposit of coins of a predetermined value, lock out the operation of both tiers of ejectors of parent machine 75. The parent machine latch mechanism 85, through a pair of parallel linkages 43 and 47, operates the satellite latch mechanism, generally designated 50, housed on the right of satellite 20 and having latches 51 and 52, either of which directly immobilizes the drawbar assembly 31 when in latched position, that is, obstructs movement of drawbar assembly 31 beyond the initial distance hereinafter more fully described. Levers R1, R2 and R3 are similar to those shown and described in U.S. Pat. No. 2,991,867 for identically designated levers, and latches L1, L2 and L3 are those described and shown in FIGS. 7 and 8 of U.S. Pat. No. 2,952,384, as located, when in latched position, to obstruct the movement of levers (137 and 139 in U.S. Pat. No. 2,952,384) in achieving their lockout function.

Latch mechanism 85 comprises a bracket suitably secured to a right sidewall of parent machine 75 and supports a pair of vertically disposed spaced shafts 86 and 87. Latches L1, L2 and L3 radially project from hubs 91, 92 and 93 which are mounted in tandem to pivot independently of each other on shaft 86 and have pairs of radially extending angularly disposed fingers 91*a*, 91*b*, 92*a*, 92*b* and 93*a*, 93*b*, respectively. Hubs 91, 92 and 93 are each biased in a clockwise direction by a spring (not shown but similar to tension springs 191*b*, 192*b* and 193*b* of latch mechanism 185 in parent machine 175) to retain latches L1, L2 and L3 in a normal latched position, that is, in angular relation to the unlatched position shown in FIG. 3 so as to project through openings in the supporting bracket and sidewall and serve their lockout function for the parent machine 75. Latch mechanism 85 also includes rocker arms 94, 95 and 96 which are mounted on shaft 87 to pivot independently of each other and have outer ends positioned for engagement by latch release levers R1, R2 and R3 and inner ends which contact fingers 91*a*, 92*a* and 93*a*, respectively.

As will hereinafter be described in detail, latch release lever R3, as one of the components providing the dual price capability, engages its rocker arm 96 only when coins of a predetermined value are deposited for a high priced article. At all other times, as for example, when coins of a lesser value for the lower priced article are deposited, latch release lever R3 is in the raised position shown in full lines in FIG. 3 out of engagement with rocker arm 96. In order to maintain L3 in the unlatched position shown in FIG. 3 to permit operation of a lower priced ejector in parent machine 75 or satellite 20 for dispensing the lower priced articles, a high price differential assembly, generally designated 100, is provided and comprises vertical bar 101, support lever 102, auxiliary latch release crank lever 103, and tension springs 102*a* and 103*d*. Vertical bar 101 is suitably mounted for reciprocating vertical movement having the upper end thereof supported by lever 102 which is pivoted at opposite ends to the frame of the machine and to bar 101. A connecting rod 63 extends upwardly from the upper end of bar 101 to the high price actuating assembly of satellite 20 shown in FIG. 2. Tension spring 102*a* connects to the midportion of lever 102, biasing bar 101 in a normally raised position wherein a lateral extension 101*a* engages crank arm 103*b* located at one end of lever 103 to retain the opposite crank arm 103*c* in operative engagement with rocker arm 96 and maintain latch L3 in the unlatched position shown in FIG. 3. Lever 103 has an elongated intermediate portion 103*a* mounted for axial rotation in a pair of spaced supporting brackets 104, crank arms 103*b* and 103*c* being bent at right angles to portion 103*a* and in angular relation to each other for translating the vertical movement of bar 101 to the pivotal motion of rocker arm 96 and through finger 93*a* to the rotary motion of hub 93. Tension spring 103*d* urges crank arm 103*b* against lateral extension 101*a* and also rotates lever 103 clockwise to release crank arm 103*c* from engagement with rocker arm 96 when bar 101 and and lateral extension 101*a* move downwardly to permit rotation of hub 93 when release lever R3 is in the full line position thereby enabling movement of latch L3 into its latched position.

Figure 5:
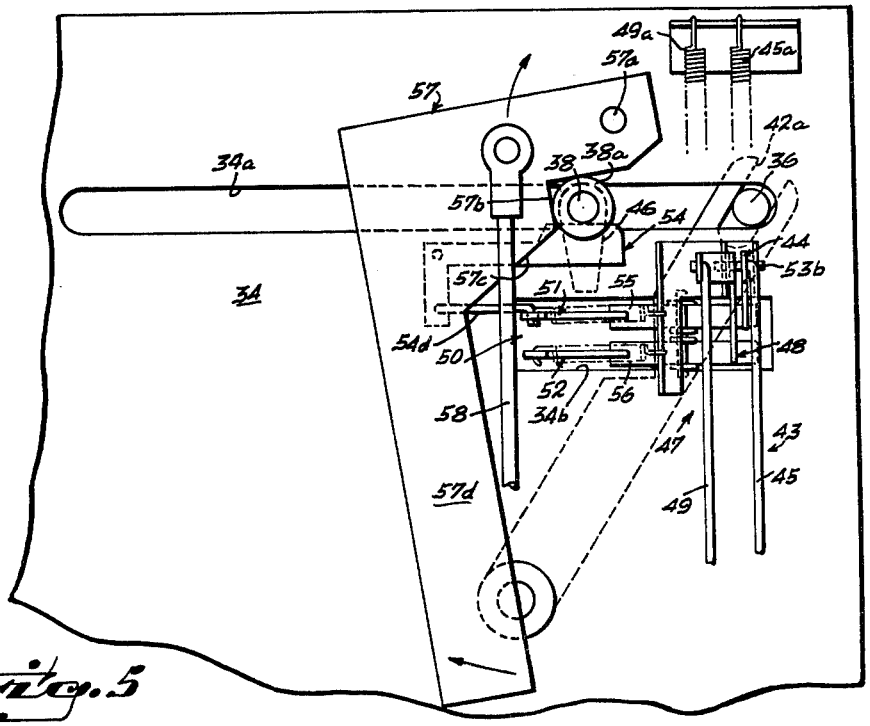
FIG. 5 is a fragmentary side elevational view of the right side of the satellite in FIG. 2 showing the heavy duty latch mechanism and components for actuating the coin-actuated totalizer or accumulator unit of the parent machine shown in FIG. 3.

Referring to FIGS. 2 and 5 wherein right sidewall 34 of satellite 20 and associated components including latch mechanism 50 are shown, right side arm 32 of drawbar assembly 31 is shown in a fully retracted rest position in which it is normally held by tension springs (not shown) for movement toward the left, as viewed in FIG. 2 in the direction of the arrow, by pullout actuation of a selected ejector E. A pair of spaced stub shafts 36 and 38 project laterally from a downwardly offset end portion of right side arm 32 and extend through horizontal slot 34*a* in right sidewall 34. Transverse shaft 39 pivotally mounts a lower end of blocking lever 42 which is located interiorly of right sidewall 34 to extend upwardly and rearwardly when at rest and engage stub shaft 36 in an open ended slot 42*a* formed at the upper end thereof to permit forward movement of right side arm 32 and shaft 36 and rotation of blocking lever 42 unless rotation of the latter is obstructed by latch mechanism 50.

As seen in FIG. 5, spaced below horizontal slot 34*a* in right sidewall 34 is a rectangular opening 34*b* in and around which components of latch mechanism 50 are located. As also shown in FIG. 2, latch mechanism 50 comprises upper and lower latches 51 and 52, tension springs 51*a* and 52*a*, cam lever 54, and upper and lower rocker arms 55 and 56. Upper and lower latches 51 and 52 are mounted to pivot independently of each other in horizontal planes on shaft 53 which is vertically supported by suitable brackets secured to the interior side of right sidewall 34 and have laterally extending ears to which tension springs 51*a* and 52*a*, respectively, are attached biasing latches 51 and 52 in a counterclockwise direction to position edges 51*b* and 52*b* thereof, respectively, in the path of movement of blocking lever 42 when not otherwise restrained. Blocking lever 42 has a wedge-shaped cutout formed along the forward edge thereof providing a vertically disposed edge 42*b* for engagement by edges 51*b* and 52*b* when latches 51 and 52 are in latched position. Latches 51 and 52 have rearward extensions 51*c* and 52*c* located to engage inner, forwardly projecting ends of rocker arms 55 and 56, respectively, which pivot independently of each other on vertical shaft 53*a* spaced rearwardly of shaft 53 and supported in similar fashion.

Cam lever 54 pivots on horizontally supported pin 54*a* and is located on the exterior side of the right sidewall 34 to locate an upwardly stepped cam edge 54*b* thereof for engagement by stub shaft 38 projecting through slot 34*a*. The lower end of a downwardly projecting arm portion 54*c* of cam lever 54 has a link 54*d* connecting to the laterally projecting ear of latch 51 to retain the latter in an unlatched position against the action of spring 51*a* as long as stub shaft 38 rides on stepped cam edge 54*b*. As stub shaft 38 carried by side arm 34, in moving forwardly, rides off cam edge 54*b*, cam lever 54 rotates counterclockwise and releases latch 51 for counterclockwise rotation, as seen in FIG. 2, by the action of spring 51*a* to a latched position wherein edge 51*b* extends across the path of movement of blocking lever 42 to engage vertical edge 42*b* thereof. This occurs before blocking lever 42 passes latch edge 51*b* and prevents further rotation of blocking lever 42 which in turn locks out further forward movement of drawbar assembly 31 and thus ejectors E, unless a predetermined amount of coins for the lower priced articles has been deposited in the coin-actuated totalizer unit located in parent machine 75, in which case latch 51 is retained in the unlatched position by rocker arm 55 in the manner more fully hereinafter described.

As seen in FIGS. 2 and 3, the pair of parallel linkages, generally designated 43 and 47 comprise a pair of levers 82, 44 and 83, 48 interconnected by rods 45 and 49, respectively. Levers 82 and 83, located in parent machine 75, are mounted on pins 82*a* and 83*a* to pivot on a horizontal axis with ends 82*b* and 83*b* engaging the outer ends of rocker arms 97 and 98 and opposite ends 82*c* and 83*c* are pivotally connected to the lower ends of rods 45 and 49, respectively. Rocker arms 97 and 98 pivot independently of each other on a vertical pin 97*a* supported in a bracket which is mounted adjacent latch mechanism 85 to position the inner ends of rocker arms 97 and 98 for engagement by fingers 92*b* and 93*b* projecting from hubs 92 and 93, respectively. Levers 44 and 48 are located in satellite 20 and are mounted at midportions on a horizontally supported shaft 53*b* to pivot on a horizontal axis with ends 44*a* and 48*a* engaging the outer, rearwardly projecting ends of rocker arms 55 and 56, respectively. The opposite ends 44*b* and 48*b* are pivotally connected to the upper ends of rods 45 and 49, respectively. Tension springs 45*a* and 49*a* act between lever ends 44*b* and 48*b* and suitable attachments to an upper portion of right sidewall 34, independently biasing linkages 43 and 47, respectively, into raised positions wherein lever ends 82*b* and 83*b* are retained against rocker arms 97 and 98, and ends 44*a* and 48*a* of levers 44 and 48 are pulled away from rocker arms 55 and 56 permitting a quick response by latches 51 and 52 rotating into latched positions by the actions of springs 51*a* and 52*a*, respectively. When latches L2 and L3 are unlatched, linkages 43 and 47 respond by rotating rocker arms 55 and 56 counterclockwise to likewise unlatch latches 51 and 52, respectively.

As seen in FIG. 5, a pin 57*a* is mounted on the exterior of right sidewall 34 to project laterally above horizontal slot 34*a*. Cam lever 57 pivots on pin 57*a* for clockwise rotation from the rest position shown to raise rod 58 and actuate coin handling assembly 88 (see FIG. 3) to which rod 58 connects at the lower end thereof in parent machine 75. Stub shaft 38, extending through slot 34*a*, terminates beyond cam lever 54 in a roller 38*a* which engages a reentrant corner 57*b* of cam lever 57 when the latter and rod 58 are at rest, that is, when right side arm 32 with stub shafts 36 and 38 is fully retracted. As an ejector E is pulled forward, stub shaft 38, in response thereto, enables roller 38*a* to rotate cam lever 57 through a limited arc in riding out of reentrant corner 57*b* and onto sloping edge 57*c*. This raises rod 58 sufficiently to rotate main coin handling shaft 89 and actuate the coin-actuated totalizer or accumulator unit which swings the release levers R1 and R2 thereof (when correct coin deposit has been made) against the outer ends of rocker arms 94 and 95, respectively, all in accordance with the basic operation of the parent machine 75. Fingers 91*a* and 92*a*, when engaged by the inner ends of rocker arms 94 and 95, rotate hubs 91 and 92 counterclockwise and locate latches L1 and L2 in the unlatched position shown in FIG. 3. This unlatching is transmitted through linkage 43 to rocker arm 55 which retains latch 51 against counterclockwise rotation into a latched position when stub shaft 38 rides off stepped cam edge 54*b* keeping drawbar assembly 31 and ejector E free to complete the forward stroke. The movement of release levers R1 and R2, as just described and as more fully disclosed in said U.S. Pat. No. 2,991,867, will take place, as noted, only when the predetermined amount of coins have been deposited. When no coins or an insufficient amount are deposited, the raising of rod 58 by an ejector E being pulled out a limited distance fails to move release levers R1 and R2 so that hubs 91 and 92 remain stationary remaining latches L1 and L2 in latched position and locking out further operation of parent machine 75. This in turn permits linkage 43 to remain in a raised position by spring 45*a* causing lever 44 to be released from rocker arm 55. According, when no coins or an insufficient amount of coins is deposited, as stub shaft 38 rides off stepped cam edge 54*b* on operating an ejector E, spring 51*a* rotates latch 51 counterclockwise to position edge 51*b* in the path of blocking lever 42 and locking drawbar assembly 31 and ejectors E from further forward movement preventing dispensing of merchandise from satellite 20.

The heavy duty aspect of latch mechanism 50 will now be apparent. When either latch 51 or 52 is in latched position, any excessive force applied to ejectors E is transmitted to the relatively sturdy drawbar assembly 31 and blocking lever 42 and then through latch 51 or 52 directly to right sidewall 34 which is part of the frame of satellite 20, linkages 43 and 47 being entirely free from stress or backlash from such excessive force as is also the mutual lockout linkage on the left side of the machines.

Stub shaft 38 pivotally mounts a dog 46 which is biased by spring 46*a* into a neutral vertical position for coacting with the teeth of ratchet bar 46*b* mounted on the interior of right sidewall 34. Dog 46 and ratchet bar 46*b* will be recognized as conventional means for preventing undesirable reversal of movement of drawbar assembly 31 and ejectors E before the fully forward position is attained during the forward stroke, and also before the retracted position is reached on the return stroke. Thus, dog 46 enagaes the teeth of ratchet bar 46*b* after stub shaft 38 has cleared stepped cam edge 54*b* and rod 58 has been raised to operate coin handling assembly 88 and unlatch latches L1, L2 and 51.

The dual pricing capability in satellite 20 is provided by the high price coin detection mechanism, generally designated 60, which comprises transverse shaft 25, its lever arm 26 and lever 61, connecting rod 63 extending between lever 61 and high price differential assembly 100 in parent machine 75, and a keeper latch 62. Lever 61 is mounted at one end thereof to rotate with an end of shaft 25 projecting from the exterior of sidewall 34 and extends forwardly terminating in free end 61*b* which coacts with keeper latch 62. A midportion of lever 61 pivotally connects to the upper end of connecting rod 63 and is biased by spring 61*a* to a raised position. Springs 61*a* and 102*a* act together to maintain rod 63 and bar 101 in raised, rest position shown in FIGS. 2 and 3. Keeper latch 62 is pivoted on a horizontally disposed pin 62*a*, suitably mounted on right sidewall 34 and pivots in a vertical plane parallel to the frontal plane of satellite 20 and perpendicular to the pivotal plane of lever 61. A downward extension 62*b* along the right side of keeper latch 62 terminates at its lower end in a leftward projecting latch element 62*c* and provides clearance for clockwise rotation of keeper latch 62 when lever 61 is at rest in the raised position shown in FIG. 2. When keeper latch 62 is in the normal rest position shown in FIG. 2 to which it is biased by tension spring 62*d*, extension 62*b* and latch element 62*c* are located to the right of the pivotal plane of lever 61. This permits the free end 61*b* of lever 61 to clear and move below latch element 62*c* in response to forward movement of one of the cam plates 24 which engages lever arm 26 to rotate shaft 25. A horizontal flange 62*e* formed along the upper end of keeper latch 62 has a beveled cam edge 62*f* located in the patch of movement of right side arm 32 for engagement thereby to rotate keeper 62 clockwise so that latch element 62*c* will obstruct the path of lever free end 61*b*. The location of cam edge 62*f* is such that engagement by the front end of side arm 32 and the pivoting of keeper latch 62 occurs after ejector E and drawbar assembly 31 has moved forwardly the hereinbefore described distance required to actuate the coin-actuated totalizer unit.

Likewise, the rotation of shaft 25 by cam plate 24 occurs prior to actuation of keeper latch 62 by side arm 32.

To summarize the high price vending operation of satellite 20, one or more of the magazines M are stocked with the high priced merchandise and each pusher head 22 thereof is fitted with a cam plate 24 and the coin-actuate totalizer unit in parent machine 75 is set to operate latch release lever R3 when a predetermined value of coins for the purchase of the high priced merchandise is deposited.

High price coin detection mechanism 60 is brought into play under two conditions, namely, (1) when the proper amount of coins are deposited as required for the higher priced merchandise, and (2) when an amount of coins required for the lower priced merchandise is deposited and the ejector E of a higher priced magazine M is pulled. Under a third possibility, namely, when no coins or an insufficient amount for the lower priced merchandise is deposited and a higher priced ejector E is pulled, latches L1, L2 and 51 will be effective as hereinbefore described to lockout the operation of both satellite 20 and parent machine 75.

As to the first condition, as ejector E of a higher priced magazine M is pulled forward along with drawbar assembly 31, cam lever 57 through rod 58 and coin handling assembly 88 actuates release levers R1, R2 and R3, as previously described, to engage rocker arms 94, 95 and 96. This moves latches L1 and L2 from latched, rest position to the unlatched position shown in FIG. 3, latch L3 being normally retained in unlatched position by price differential assembly 100. Latches l2 and L3 through linkages 43 and 47 maintain latches 51 and 52, respectively, in unlatched position in the manner hereinbefore described. As ejector E is pulled in the direction of the arrow shown in FIG. 1, cam plate 24 engages lever arm 26 and rotates shaft 25 and lever 61 to move connecting rod 63 and price differential assembly 100 downwardly disengaging crank arm **103*c* from rocker arm 96. Since latch release lever R3 in now in the position shown in broken lines in FIG. 3 engaging rocker arm 96, latches L3 and 52 remain in their unlatched positions. Thus, ejector E and drawbar assembly 31 are free to complete their stroke whereby rod 58 is raised a distance sufficient to lock the coin return, drop the coins into the collection box and reset the coin-actuated totalizer or accumulator unit all in the manner described in said U.S. Patent 4,121,707 and U.S. Pat. Nos. 2,952,384 and 2,991,867. During the forward stroke and after lever 61 has moved to the lowered position shown in broken lines in FIG. 2, the front end of right side arm 32 engages beveled edges 62*f* and rotates keeper latch 62 in a clockwise direction to locate latch element 62*c* in the path of and above free end 61*b* of lever 61, as shown in broken lines, in order to retain the latter in a lowered position as cam plate 24 rides off lever arm 26 at the end of the forward stroke of ejector E. As cam plate 24 reengages lever arm 26 during the return stroke, lever 61 is again pushed downwardly out of engagement with latch element 62*c* allowing keeper latch 62 to return to the rest position under the tension of spring 62*d* after release from engagement with right side arm 32. At the end of the return stroke, cam plate 24 releases lever arm 26 whereby lever 61, connecting rod 63 and price differential assembly 100, under the tension of springs 61*a* and 102*a*, all return to the raised, rest position with crank arm 103*c* retaining latches L3 and 52** in unlatched position preparatory to the next stroke.

As to the second condition, as ejector E of a higher priced magazine M is pulled forward along with drawbar assembly 31, cam lever 57, through rod 58 and coin handling assembly 88, actuates only latch release levers R1 and R2, release lever R3 remaining in the position shown in full lines in FIG. 3 disengaged from rocker arm 96. As ejector E moves forward, cam plate 24 engages lever arm 26 and rotates shaft 25 and lever 61 to move connecting rod 63 and price differential assembly 100 downward disengaging crank arm **103*c* from rocker arm 96. With release lever R3 also disengaged from rocker arm 96, hub 93 rotates clockwise, moving latch L3 to a latched position and also permitting rocker arm 98 to rotate counterclockwise which releases lever 83. Spring 49*a* responds by raising rod 49, rotating lever 48 counterclockwise and releasing rocker arm 56, whereby latch 52, actuated by spring 52*a*, swings into position blocking further movement of blocking lever 42, drawbar assembly 31 and ejector E, and preventing dispensing of the high priced merchandise. As ejector E is released after being blocked, cam plate 24 disengages lever arm 26, releasing shaft 25 for clockwise rotation, as seen in FIG. 2, raising rod 63 and returning price differential assembly 100 by the action of springs 61*a* and 102*a* to a normal, rest position wherein crank arm 103*c* engages rocker arm 96 to rotate hub 93 counterclockwise to the unlatched, rest position for latch L3. High price linkage 47 responds by reversing the action hereinbefore described and rotates rocker arm 56 counterclockwise to bring high price latch 52** into unlatched, rest position preparatory to operation of a low price ejector E.

Figure 6:
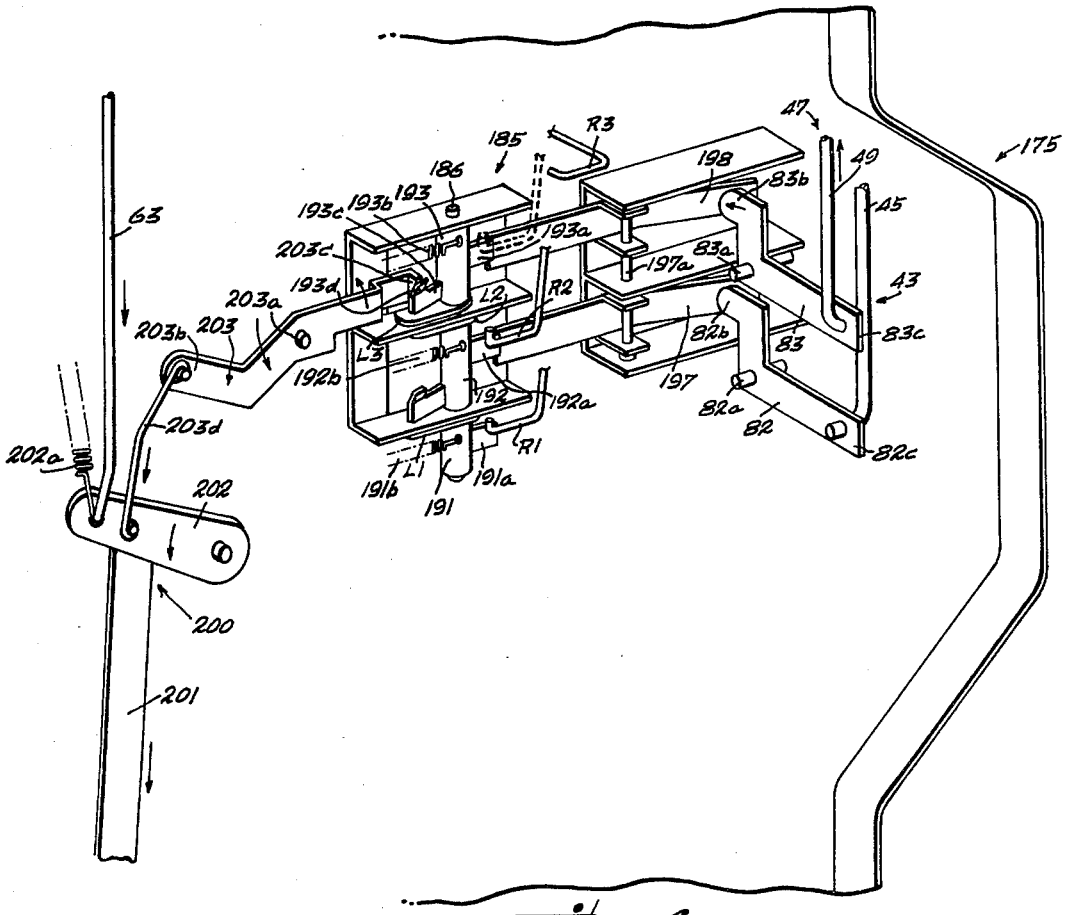
FIG. 6 is a fragmentary schematic perspective view similar to FIG. 3 but of another parent machine for the satellite shown in FIGS. 1 and 2 embodying the invention.

Referring now to FIGS. 6 and 7 showing components of the right and left sides, respectively, of parent machine 175 which is substantially the vending machine described in U.S. Pat. No. 3,128,908, the left side operating components of which are shown modified for satellite function in FIGS. 4, 4A, 4B and 7 of said U.S. Pat. No. 4,121,707, FIG. 7, herein, schematically shows components on the left side of parent machine 175 comparable to those shown in FIG. 7 and described in detail in said patent. The parent machine 175 in FIGS. 6 and 7 herein is shown modified for use with satellite 20 as shown in FIGS. 2 and 1, respectively.

Slide 178, which is slide 102 in said patent, in its horizontal reciprocation, not only performs substantially the same function as slide 78 in parent machine 75, namely, that of a component of the mutual lockout mechanism between the drawbar assembly 31 of the satellite and the selector bar mechanisms 80 of the parent, but also actuates the main coin handling shaft 189 in parent machine 175 in the manner hereinafter described and also in more detail in said patent. This permits the omission of cam lever 57 and rod 58 from the right side of satellite 20 when installed in parent machine 175. The main coin handling shaft 189 corresponds to the horizontal shaft designated 74 in said U.S. Pat. No. 4,121,707, 137 in U.S. Pat. No. 3,128,908, and 77 In U.S. Pat. No. 2,991,867 and performs the same function as shaft 89 in machine 75 shown in FIG. 3.

The lower end of push rod 41 extending downwardly from plate 40 on the left side of satellite 20 connects to one corner of an intermediate bell crank 177 pivoted at the apex on pin **177*a*. An open ended slot 177*b* at the other corner of bell crank 177 is engaged by a pin 178*d* rigidly mounted on an upwardly extending tab located adjacent the rear end of slide 178. Spaced pins 178*a* fixedly mounted to extend through spaced horizontal slots 178***b* provide for the slidable mounting of slide 178 which is formed, adjacent the front end thereof, with cam edges 178*c* for engaging the pair of blocking plates 179 pivotally mounted on pins 179*a* and having cam surfaces 179*b* offset and disposed at an angle to the plane of rotation thereof. Cam surfaces 197*b* coact with extensions 181*a* of left end tumblers 181 and tumblers 180*a* of selector bar mechanisms 180 in parent machine 175 in the same manner as hereinbefore described for the coaction of cam surfaces 79*b* with the similar components of selector bar mechanism 80 in parent machine 75.

To summarize the mutual lockout function between satellite 20 and parent 175, forward movemnt of stub shaft 37, when one of the ejectors in satellite 20 is pulled out, rotates plate 40, raises push rod 41, rotates bell crank 177 counterclockwise and moves slide 178 forwardly (toward the right as seen in FIG. 7) which in turn rotates the upper blocking plate 179 clockwise and the lower blocking plate 179 counterclockwise, in the direction of the arrows, to engage the respective left end tumbler extensions 181*a*, sliding the tumblers 181 to the right and locking out both selector bar mechanisms 180 and the tiers of ejectors thereof. Likewise, when slide 178 is in the normal rest position and an ejector on one of the tiers of parent machine 175 is pulled out, selector bar mechanism 180 in that tier slides the left end tumbler 181 thereof toward the left to engage its blocking plate 179 and prevent forward movement of slide 178 which locks out the ejectors E in satellite 20 by immobilizing drawbar assembly 31 in the manner also described in said pending patent application. It will be understood that the ejectors in the non-operated tier of parent machine 175 are also simultaneously locked out by suitable means in the parent machine as more fully described in said pending application.

To actuate the main coin handling shaft 189 of coin handling assembly 188, a lever arm 189*a* rotates therewith and has a pin 189*b* which rides in intersecting vertical and arcuate slots 178*e* and 178*f*, respectively, pin 189*b* being located at the upper end of the vertical slot 178*e* where it intersects with the upper end of arcuate slot 178*f* when both slide 178 and main coin handling shaft 189 are at rest position shown in FIG. 7. Movement of slide 178, when actuated by an ejector E in satellite 20, is transmitted through pin 189*b* riding in vertical slot 178*e* to rotate main coin handling shaft 189, arcuate slot 178*f* permitting main coin handling shaft 189 to be operated by an ejector in parent machine 175 when slide 178 is locked in rest position by selector bar mechanism 180.

FIG. 6 herein, shows the latch mechanism 185 and connecting rocker arms 197 and 198 to parallel linkages 43 and 47 of satellite 20, shown in FIG. 2, and the high price differential assembly 200 joined by connecting rod 63. Latch mechanism 185 comprises a suitably supported vertical shaft 186 on which hubs 191, 192 and 193 pivot in tandem independently of each other. Latches L1, L2 and L3 radially project from hubs 191, 192 and 193, respectively, and operate in the same manner as those in parent machine 75. Hubs 191, 192 and 193 also have radially projecting fingers 191*a*, 192*a* and 193*a*, respectively, which extend for engagement by latch release levers R1, R2 and R3, to be pivoted thereby in a counterclockwise direction for individually positioning latches L1, L2 and L3, respectively, in the unlatched position shown in FIG. 6. Hub 193 also has a radially projecting finger 193*c* extending in angular relation to finger 193*a*, finger 193*c* terminating in an angular cam portion 193*d*. Tension springs 191*b*, 192*b* and 193*b* attach to hubs 191, 192 and 193, respectively, biasing the latter for clockwise rotation of latches L1, L2 and L3 into a latched position. Associated with latch mechanism 185 are a pair of rocker arms 197 and 198 which pivot independently of each other on a vertical pin 197*a* supported in a suitably mounted bracket to locate the inner ends thereof for engagement by fingers 192*a* and 193*a*, respectively. The opposite or outer ends of rocker arms 197 and 198 are positioned for engagement by the ends 82*b* and 83*b* of levers 82 and 83 which are components of linkages 43 and 47, respectively, and are installed in parent machine 175 to operatively interconnect latch mechanism 185 with latch mechanism 50 of satellite 20 and function in the same manner as hereinbefore described with reference to parent machine 75.

The high price differential assembly 200 in parent machine 175 is seen to comprise a vertical bar 201, supported by a pivoted lever 202, biased in a raised position by spring 202*a*. A latch release cam lever 203 pivots at a midportion thereof on a suitably mounted pin 203*a* and has an inner cam end 203*c* extending to engage angular cam portion 193*d* of finger 193*c* and an opposite outer end 203*b* which is suitably connected by link 203*d* to lever 202. When in the raised, rest position shown in FIG. 6, lever 202 retains inner cam end 203*c* in engagement with angular cam portion 193*d* to retain high price hub 193 and its latch L3 in an unlatched postion which, through high price rocker arm 198 and linkage 47, likewise retain latch 52 in satellite 20 in an unlatched, rest position. The lower end of connecting rod 63 from high price coin detection mechanism 60 of satellite 20 operatively attaches to lever 202 to perform the same function and in the same manner as hereinbefore described with respect to parent machine 75.

It will thus be clear that downward movement of connecting rod 63, when actuated by the high price detection mechanism 60, pushes downwardly on lever 202 and, through line 203*d*, rotates latch release cam lever 203 counterclockwise, as shown by the arrows. This moves inner cam end 203*c* upwardly to disengage from cam portion 193*d* of finger 193*c*, permitting clockwise rotation of hub 193 by action of spring 193*b* to swing latch L3 into latched position when release lever R3 is in the full line position which it assumes when insufficient coins are deposited for the higher priced article. Clockwise rotation of hub 193 releases rocker arm 198 from engagement with finger 193*a* and correspondingly releases lever 83 of linkage 47 which, in satellite 20, responsively releases rocker arm 56 and latch 52. Upon release, latch 52 by action of spring 52*a* swings into latched position unless the predetermined mount of coins for the higher priced article has been deposited to move latch release lever R3 to its broken line position to effectively retain latches L3 and 52 in their unlatched positions.

To summarize the operation of satellite 20 when installed on parent machine 175 and fitted with heavy duty latch mechanism 50 and set up for dual pricing, when in rest position, latch release levers R1, R2 and R3 are all disengaged from the fingers on hubs 191, 192 and 193 which are spring biased in latched position. However, price differential assembly 200 normally retains hub 193 and its latch L3 in unlatched position. These conditions are reflected in latch mechanism 50 by latch 52 being likewise retained by linkage 47 in unlatched position and linkage 43 being raised and out of engagement with rocker arm 55, but latch 51 being retained in unlatched position by stub shaft 38 and cam lever 54. When no coins or an insufficient amount of coins are deposited in the coin-actuated totalizer unit of parent machine 175 and an ejector E in satellite 20 is pulled, drawbar assembly 31 moves forwardly to pull upwardly on push rod 41 moving slide 178 forwardly and actuating the main coin handling shaft 189. Also, this failure to deposit the correct coin amount maintains latch release levers R1, R2 and R3 out of contact with the fingers of hubs 191, 192 and 193, respectively, so that latches L1 and L2 remain latched, latch L3 being retained in unlatched position by high price differential assembly 200 in its rest position. As stub shaft 38 rides off stepped cam edge 54*b*, cam lever 54 rotates counterclockwise releasing latch 51, which by the action of spring 51*a* swings into latched position and blocks further forward movement of blocking lever 42 and drawbar assembly 31 and locking out movement of ejectors E beyond this initial distance.

The operation of satellite 20 installed on parent machine 175 under conditions of proper coin deposit for both high and low price merchandise and also when a high price ejector E is actuated with only a low price deposit of coins parallels the operation hereinbefore described in detail of satellite 20 and parent machine 75 under the same conditions, notwithstanding the omission of cam lever 57 and rod 58 from satellite 20 when installed on parent machine 175, and will be readily apparent therefrom.

It will also be clear that the arrangement of linkage 43 and the retention of latch 51 initially in unlatched position by cam lever 54 and stub shaft 38 ensures smooth operation for dispensing merchandise when the proper coin deposits are made by reducing the time lag and by lessening the load on latch release lever R2 which otherwise would be solely relied on to overcome spring 51*a* and unlatch latch 51.

The satellite vending machine having a heavy duty latch mechanism and a dual pricing capability adapted for installation on either of two types of existing vending machines herein disclosed is seen to achieve the several objects of the invention and to be well adapted to meet conditions of practical use. As various possible embodiments might be made of this invention, and as various changes might be made in the disclosed constructions, it is to be understood that all matters herein set forth or shown in the accompanying drawings are to be interpreted as illustrative and not in a limiting sense.

What is claimed is:

1. The combination of a parent vending machine with a satellite machine mounted thereon, said parent machine including a plurality of ejectors and a coin actuated totalizer having a plurality of movable latch release levers and a plurality of latches adapted to be moved into a latched and unlatched state by said release levers as a function of the position of the latter relative to said latches governed by coin deposit in said parent machine, said satellite machine also having a plurality of ejectors and a plurality of latches adapted to be latched and unlatched for respectively preventing and enabling operation of the satellite ejectors, each of said ejectors of the parent and satellite machines being adapted to dispense an article stored in an associated magazine by manual operation of said ejector on predetermined coin deposits in said parent machine, mutual lockout linkage means for all said ejectors in both parent and satellite machines except the selected ejector, and means interconnecting said latches of said coin actuated totalizer with said latches of said satellite machine, said interconnecting means being operative to allow latching of some only of said latches of the satellite machine on deposit of a first coin amount in the parent machine and operative to allow unlatching of all of the latches of the satellite machine on deposit of a second coin amount in the parent machine.

2. The combination defined in claim 1, in which said satellite has a supporting frame mounting the satellite latches for transmitting directly to said frame excessive force if exerted on the satellite ejectors when the latter is prevented from operation by the satellite latches.

3. The combination of a parent vending machine with a satellite machine mounted thereon, a plurality of ejectors on each machine for selective manual pullout and return actuation thereof to dispense articles stored in the respective machine, a latch mechanism in each machine for locking and releasing the ejectors of the respective machine, a coin-actuated totalizer unit located in the parent machine having a latch release means adapted to unlatch the latch mechanism of the parent machine as a function of coin deposit in the parent machine, a linkage between said parent and said satellite latch mechanism for operating the satellite latch mechanism under direct control of the latch mechanism of the totalizer unit in the parent mechanism, and means, independent of said linkage, for normally maintaining unlatched said satellite latch mechanism and being responsive to pullout movement of a satellite ejector on predetermined coin deposit in the parent machine to release the satellite latch mechanism for positioning by said linkage in response to the positioning of the parent latch mechanism.

4. The combination defined in claim 3, in which said satellite machine has a drawbar assembly comprising a transverse bar and a side arm extending in perpendicular relation and connected for forward and rearward movement therewith, said transverse bar being located for forward movement by said pullout actuation of each of said satellite ejectors and adapted to lockout said satellite ejectors when immobilized, a blocking lever rotatably mounted at one end thereof and having an opposite free end extending adjacent said side arm, means interconnecting said side arm and blocking lever free end for mutual coaction therebetween, said satellite latch mechanism when in latched position extending across the path of rotation of said blocking lever to obstruct movement thereof and of said coacting side arm to effect said blocking of the satellite ejectors preventing article dispensing.

5. The combination defined in claim 4, in which said parent machine includes a rotatable shaft for actuating said latch release means, and interconnecting means between said side arm and said rotatable shaft for converting said forward and rearward movement of said side arm to rotary movement of said shaft to effect said latch release means unlatching of the parent latch mechanism.

6. The combination defined in claim 5, including means interconnecting said side arm and said satellite latch mechanism for normally retaining the latter in unlatched position and being effective, in response to initial pullout movement of the satellite ejector and side arm, to release said satellite latch mechanism for positioning by said linkage in response to the positioning of the parent latch mechanism.

7. The combination defined in claim 6, in which said interconnecting means between said side arm and rotatable shaft and said means interconnecting said side arm and said satellite latch mechanism include a stub shaft radially projecting from said side arm and slidingly operating a pair of cam levers, one cam lever being connected to said rotatable shaft and the other cam lever being linked to said latch mechanism.

8. The combination defined in claim 3, in which said satellite machine has a drawbar assembly comprising a transverse bar and a pair of side arms extending in perpendicular relation and connected to opposite ends thereof for forward and rearward movement therewith, said transverse bar beng located for forward movement by said pullout actuation of each of said satellite ejectors and adapted to lockout said satellite ejectors when immobilized, mutual lockout linkage means for all said ejectors in both parent and satellite machines except the selected ejector when said predetermined amount of coins is deposited, a first of said side arms being operatively connected as a component of said mutual lockout linkage means, the latter being connected to operate said latch release means by said initial movement of said selective manual ejector actuation, means interconnecting the second of said side arms and said satellite latch mechanism for normally retaining the latter in unlatched position and being responsive to the pullout initial movement of a satellite ejector and said drawbar assembly to release said satellite latch mechanism for positioning by said linkage in response to the positioning of the parent latch mechanism.

9. The combination defined in claim 3, wherein at least one of said satellite ejectors dispenses articles of a predetermined higher price, and wherein each of said parent and satellite latch mechanisms and linkage therebetween comprises parent and satellite independently operable dual latches and linkages therebetween, a first of said dual latches and linkages being responsive to said latch release means, said coin-actuated totalizer unit having a high price latch release means for retaining the second of said parent dual latches in unlatched position when an amount of coins of said predetermined higher price is deposited therein, said parent machine having a high price differential assembly spring biased to normally retain said parent second latch and said satellite second latch by way of the second linkage in unlatched positions, and disabling means operated by said satellite high price ejectors to release said high price differential assembly against said spring bias for positioning said parent second latch and the satellite second latch through said linkage as a function of the positioning of said high price release means.

10. The combination defined in claim 9, in which said disabling means includes a rotatable transverse shaft spring extending in close proximity to said satellite ejectors and a linkage from said shaft to said high price differential assembly to effect said release on rotation of said transverse shaft from a normal position thereof, each of said high price ejectors having cam means for rotating and releasing said shaft, once on said selective pullout actuation of said high price ejector and again on said return thereof, and means retaining said linkage to the high price differential assembly in disabling position between said pullout and return actuation of said high price ejector.

11. The combination defined in claim 10, in which said satellite machine has a drawbar assembly comprising a transverse bar and a side arm extending in perpendicular relation and connected for forward and rearward movement therewith, said transverse bar being located for forward movement by said pullout actuation of each of said satellite ejectors and adapted to lockout said satellite ejectors when immobilized, said satellite latch mechanism when in latched position obstructing movement of said side arm to effect said blocking of the satellite ejectors preventing article dispensing, said drawbar assembly actuating said means retaining said linkage to the high price differential assembly in disabling position.

12. The combination of a parent vending machine with a satellite machine mounted thereon, each machine having a plurality of ejectors, each of said ejectors being adapted to dispense an article stored in an associated magazine by selective manual pullout and return actuation of said ejector, each machine having an intermediate means engaged and operated by each of the ejectors thereof on said pullout actuation, said parent machine having a coinactuated totalizer unit operated by said parent intermediate means and by said satellite intermediate means through a first linkage between parent and satellite, said parent machine having a first plurality of latches at rest in a normally latched position obstructing movement of said parent intermediate means beyond a predetermined initial distance and locking out said parent machine ejectors from said article dispensing, said parent coin-actuated totalizer unit having means for releasing said first plurality of latches to an unlatched position responsive to the movement of either said parent or satellite intermediate means through pullout of a respective ejector thereof said initial distance when a predetermined amount of coins is deposited in said totalizer unit, said totalizer unit otherwise being unresponsive and permitting said first plurality of latches to remain latched, a second plurality of latches located in said satellite for obstructing movement of said satellite intermediate means beyond said predetermined initial distance to thereby lock out said satellite ejectors, and linkage means between said first and second plurality of latches, said linkage means being operative to allow latching of some only of said latches of the satellite machine on deposit of a first coin amount in the parent machine and operative to allow unlatching of all of the latches of the satellite machine on deposit of a second coin amount in the parent machine.

13. The combination defined in claim 12, including a mutual lockout linkage means for all said ejectors in both parent and satellite machines except the selected ejector when said predetermined amount of coins is deposited in said totalizer unit.

14. The combination defined in claim 12, in which at least one of said satellite ejectors dispenses articles of a predetermined higher price, a high price vending means for said high price ejectors comprising a high price latch in said parent machine, a high price latch in said satellite responsive to the positioning of said parent high price latch through an interconnecting linkage to obstruct movement of said satellite intermediate means beyond said initial distance, said coin-actuated totalizer unit having a high price latch release means for retaining said parent high price latch in an unlatched position responsive to the movement of said satellite intermediate means through pullout of said satellite high price ejectors when an amount of coins of said predetermined higher price is deposited, a high price differential assembly in said parent machine normally retaining said parent and satellite high price latches in unlatched position, and disabling means actuated by said satellite high price ejectors to release said high price differential assembly for positioning said parent and satellite high price latches by said totalizer unit high price latch release means.

15. The combination of a parent vending machine with a satellite machine mounted thereon, a plurality of ejectors on each machine for selective manual pullout and return actuation thereof to dispense articles stored in the respective machine, a latch mechanism in each machine for locking and releasing the ejectors of the respective machine, a coin-actuated totalizer unit located in the parent machine having a latch release means adapted to unlatch the latch mechanism of the parent machine as a function of coin deposit in the parent machine, a linkage between said parent and said satellite latch mechanism for operating the satellite latch mechanism under direct control of the latch mechanism of the totalizer unit in the parent mechanism, said linkage between said parent and satellite mechanisms including parent and satellite levers located for engagement with the respective latch mechanisms, a rod interconnecting said levers for movement in the same direction, and a spring biasing said linkage in a direction whereby said parent lever engages the parent latch mechanism and said satellite lever disengages from said satellite latch mechanism facilitating movement of the latter to a latched position.

16. The combination defined in claim 15, including means, independent of said linkage, for normally maintaining unlatched said satellite latch mechanism and being responsive to initial pullout movement of a satellite ejector to release said satellite latch mechanism for movement to its latched position, said parent latch mechanism, when unlatched by said latch release means, governed by predetermined coin amount deposit in the parent machine, actuating said parent lever against the bias of said spring to engage said satellite lever with said satellite latch mechanism thereby to prevent the latter from moving to its latched position when released by said independant means.

17. The combination defined in claim 15, in which said parent latch mechanism comprises a hub mounted for rotation on a first shaft and has a latch member radially extending for swinging between a latched and unlatched position on rotation of the hub by said latch release means, said hub having a radially extending finger, a rocker arm rotatably mounted on a second shaft spaced from said first locating one end of the rocker arm in operative engagement with said finger, the opposite end of said rocker arm being located for said engagement with the parent lever of said linkage whereby rotation of said hub from latched to unlatched position actuates said linkage against the action of said spring.

18. The combination of a parent vending machine with a satellite machine mounted thereon, each machine having a plurality of ejectors, each of said ejectors being adapted to dispense an article stored in an associated magazine by selective manual pullout and return actuation of said ejector, each machine having an intermediate means engaged and operated by each of the ejectors thereof on said pullout actuation, said parent machine having a coin-actuated totalizer unit operated by said parent intermediate means and by said satellite intermediate means through a first linkage between parent and satellite, said parent machine having a first latch mechanism at rest in a normally latched position obstructing movement of said parent intermediate means beyond a predetermined initial distance and locking out said parent machine ejectors from said article dispensing, said parent coin-actuated totalizer unit having means for releasing said first latch mechanism to an unlatched position responsive to the movement of either said parent or satellite intermediate means through pullout of a respective ejector thereof said initial distance when a predetermined amount of coins is deposited in said totalizer unit, said totalizer unit otherwise being unresponsive and permitting said first latch mechanism to remain latched, a second latch mechanism located in said satellite for obstructing movement of said satellite intermediate means beyond said predetermined initial distance and locking out said satellite ejectors, a second linkage between said first and second latch mechanisms whereby the second latch mechanism responds to the positioning of said first latch mechanism when said satellite intermediate means completes said initial distance movement on pullout of an ejector in the satellite machine, at least one of said satellite ejectors dispensing articles of a predetermined higher price, a high price vending means for said high price ejectors comprising a high price latch in said parent machine, a high price latch in said satellite responsive to the positioning of said parent high price latch through an interconnecting linkage to obstruct movement of said satellite intermediate means beyond said initial distance, said coinactuated totalizer unit having a high price latch release means for retaining said parent high price latch in an unlatched position responsive to the movement of said satellite intermediate means through pullout of said satellite high price ejectors when an amount of coins of said predetermined higher price is deposited, a high price differential assembly in said parent machine normally retaining said parent and satellite high price latches in unlatched position, and disabling means actuated by said satellite high price ejectors to release said high price differential assembly for positioning said parent and satellite high price latches by said totalizer unit high price latch release means.

* * * * *